US011788796B2

(12) United States Patent
Jiang et al.

(10) Patent No.: US 11,788,796 B2
(45) Date of Patent: Oct. 17, 2023

(54) HEAT CONDUCTION DEVICE WITH INNER LOOP

(71) Applicant: NIDEC CHAUN-CHOUNG TECHNOLOGY CORPORATION, New Taipei (TW)

(72) Inventors: Wen-Hsiung Jiang, New Taipei (TW); Chun-An Shen, New Taipei (TW); Chien-Cheng Huang, New Taipei (TW)

(73) Assignee: NIDEC CHAUN-CHOUNG TECHNOLOGY CORPORATION, New Taipei (TW)

( * ) Notice: Subject to any disclaimer, the term of this patent is extended or adjusted under 35 U.S.C. 154(b) by 0 days.

(21) Appl. No.: 17/398,894

(22) Filed: Aug. 10, 2021

(65) Prior Publication Data

US 2023/0047466 A1 Feb. 16, 2023

(51) Int. Cl.
*F28D 15/02* (2006.01)
*F28F 1/12* (2006.01)

(52) U.S. Cl.
CPC ..... *F28D 15/0266* (2013.01); *F28F 1/12* (2013.01); *F28F 2255/18* (2013.01)

(58) Field of Classification Search
CPC .... F28D 15/0266; F28D 15/02; F28D 15/046; F28D 15/0233; F28D 15/04; F28D 2021/0029; F28D 15/0275; F28D 15/0283; F25F 1/12; F25F 2255/18; F28F 1/12; F28F 2255/18; F28F 3/12; H05K 7/20336
See application file for complete search history.

(56) References Cited

U.S. PATENT DOCUMENTS

| | | | | |
|---|---|---|---|---|
| 10,712,099 | B2 | 7/2020 | Hoshino et al. | |
| 2005/0173098 | A1* | 8/2005 | Connors | F28D 15/0233 165/104.21 |
| 2020/0182561 | A1* | 6/2020 | Garrabrant | F28F 1/426 |
| 2020/0378690 | A1* | 12/2020 | Liu | F28D 15/04 |

FOREIGN PATENT DOCUMENTS

| | | | | |
|---|---|---|---|---|
| CN | 111163622 A | * | 5/2020 | |
| GB | 2127143 A | * | 4/1984 | F28D 15/04 |
| TW | M517314 U | | 2/2016 | |
| TW | 201804127 A | * | 2/2018 | |
| TW | M605285 U | | 12/2020 | |

OTHER PUBLICATIONS

Office Action dated Jan. 9, 2023 of the corresponding Taiwan patent application No. 110125007.

* cited by examiner

*Primary Examiner* — Harry E Arant
(74) *Attorney, Agent, or Firm* — Chun-Ming Shih; HDLS IPR SERVICES

(57) ABSTRACT

A heat conduction device with an inner loop includes a vapor chamber having at least one hole edge and a heat pipe having an outer pipe and an inner pipe. The outer pipe has a closed end and an open end communicating with the hole edge. Two ends of the inner pipe are open. The inner pipe has one end communicating with the vapor chamber through the hole edge and the other end extended along the axial direction of the outer pipe to form at least one port for communicating the closed end of the outer pipe with the inner pipe. The inner pipe is located inside the outer pipe to form a gap annularly. The port communicates with the gap, so that the inner loop is formed between the vapor chamber and the heat pipe.

4 Claims, 6 Drawing Sheets

HEAT CONDUCTION DEVICE WITH INNER LOOP

BACKGROUND OF THE DISCLOSURE

Technical Field

The technical field of this disclosure relates to a heat conduction element, and more particularly to a heat conduction device with an inner loop.

Description of Related Art

The related-art heat conduction elements such as heat pipes, vapor chambers, etc., that use an internal vacuum chamber to seal a working fluid and cause the working fluid to generate a vapor-liquid phase transition by heating or condensing are widely used for heat dissipation. Since the vapor chamber (also known as uniform temperature plate) has a large area attached to a heat source, the vapor chamber is often used as a heated portion attached to the heat source and combined with the heat pipe, and the heat pipe can erectly communicate with the vapor chamber, so that after the working fluid in the vapor chamber is vaporized and flows into the heat pipe for condensation, the condensed and liquefied working fluid is returned to the vapor chamber to achieve the purpose of circulating the working fluid for heat exchange.

However, the heat pipe itself is a tubular body. Although the end port is connected to a surface of the vapor chamber and communicates with the vapor chamber, that also indicates that the communication between the heat pipe and the vapor chamber is achieved through the end port only. Therefore, the heated and vaporized working fluid and the condensed and liquefied working fluid flow in opposite directions and both have to pass through the end port. At the aforementioned end port, the vaporized working fluid and the condensed and liquefied working fluid conflict with each other and the heat exchange efficiency is affected. Furthermore, if the liquid-state working fluid cannot flow back into the vapor chamber, it is easy to cause dry burning of the heated vapor chamber, so that the original heat conduction and heat exchange performance cannot be maintained anymore.

In view of the aforementioned drawbacks of the related-art heat conduction elements, the discloser of this disclosure based on years of experience in the related industry to conduct extensive research and experiment, and finally provided a feasible solution as disclosed in this disclosure to overcome the drawbacks of the related art.

SUMMARY OF THE DISCLOSURE

Therefore, it is a primary objective of this disclosure to provide a heat conduction device with an inner loop which is designed with inner and outer pipes and formed by combining a vapor chamber and a heat pipe, and the inner loop may avoid the conflict of the flowing directions of the vaporized working fluid and the liquid-state working fluid to achieve a smoother circulation of the working fluid for heat exchange.

To achieve the aforementioned and other objectives, this disclosure discloses a heat conduction device with an inner loop, the heat conduction device including: a vapor chamber having a first board and a second board covering each other to form an internal hollow space, and the second board having at least one hole edge formed thereon; and at least one heat pipe, including an outer pipe, and an inner pipe passing the outer pipe, and one end of the outer pipe being closed, and the other end of the outer pipe being open and communicating with the hole edge, and two ends of the inner pipe being open, and one end of the inner pipe communicating with the interior of the vapor chamber through the hole edge and the other end of the inner pipe extended along the axial direction of the outer pipe to form at least one port, and the port being provided for communicating the closed end of the outer pipe with the inner pipe; wherein, the inner pipe is disposed inside the outer pipe to form a gap annularly, and the port communicates with the gap, so that the vapor chamber and the heat pipe have an inner loop that communicates the interior of the vapor chamber with a lower end of the inner pipe, and communicates the port with the interior of the outer pipe through the interior of the inner pipe, and then communicates to the interior of the vapor chamber through the gap.

DESCRIPTION OF THE EMBODIMENTS

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
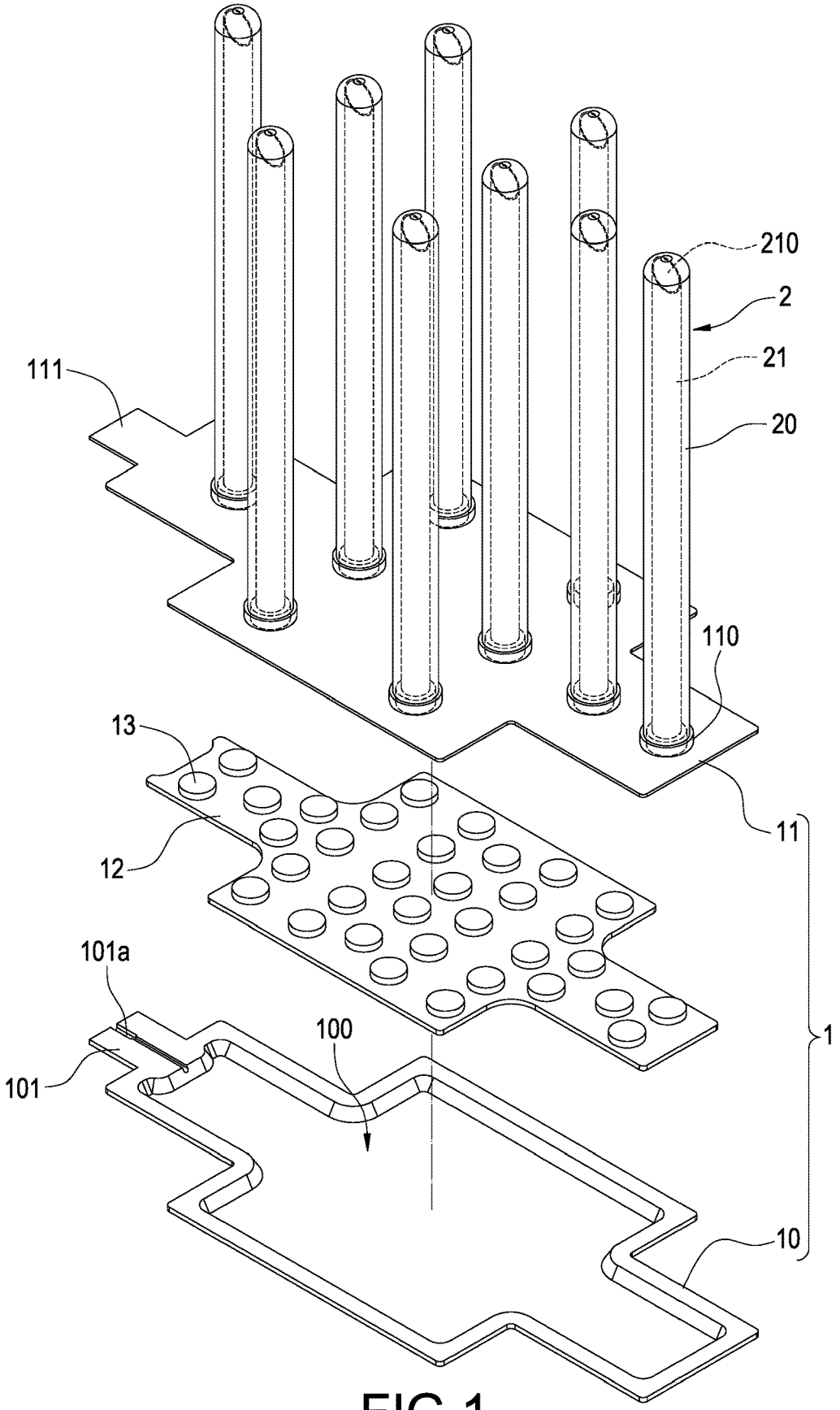
FIG. 1 is an exploded view of this disclosure.
Figure 2:
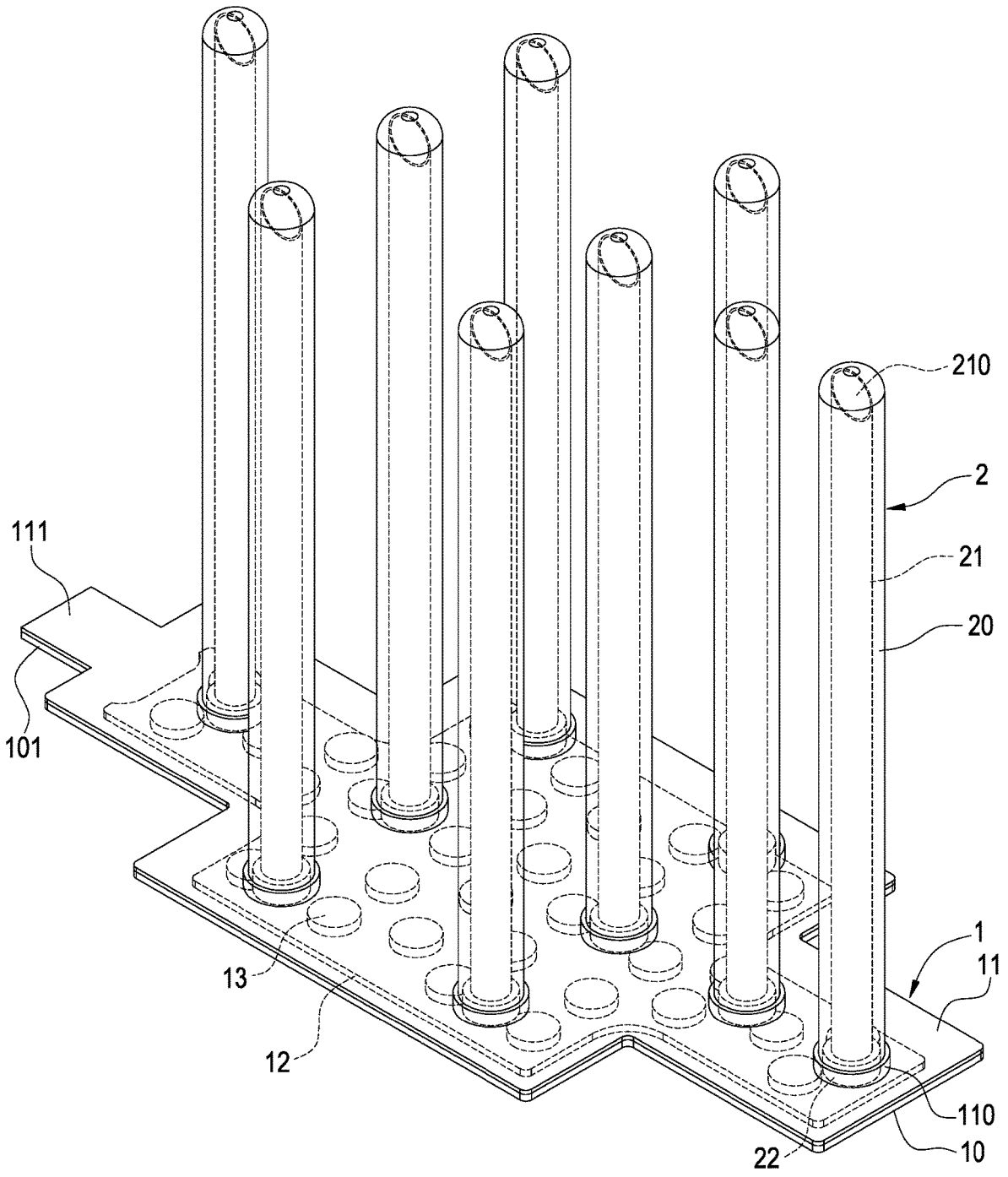
FIG. 2 is a perspective view of this disclosure.

With reference to FIGS. 1 and 2 for the exploded view and the perspective view of a heat conduction device with an inner loop of the present disclosure respectively, the heat conduction device includes a vapor chamber 1, and at least one heat pipe 2.

The vapor chamber 1 has a first board 10 and a second board 11 that cover each other to form an internal hollow space. In an embodiment of the present disclosure, the first board 10 has an accommodating portion 100 concavely formed on the first board 10 and provided for the second board 11 to cover to form the internal hollow space. In addition, the vapor chamber 1 also contains a capillary structure 12, and a plurality of support structure 13 for providing a support between the first board 10 and the second board 11. The capillary structure 12 is formed by woven mesh or powder sintering, and the support structure 13 is formed by powder sintering. If both of the capillary structure 12 and the support structure 13 are formed by powder sintering, the two may be sintered in a one-piece form.

Both of the first and second boards 10, 11 have a degassing part 101, 111 extended out from a side of the first and second boards 10, 11 separately. After the first and second boards 10, 11 cover each other, a degassing port 101*a* is reserved and provided for a degassing operation after the first and second boards 10, 11 are sealed, and the degassing parts 101, 111 may be sealed and laminated after the degassing operation, or the degassing parts 101, 111 may be cut off or removed depending on the needs.

Figure 3:
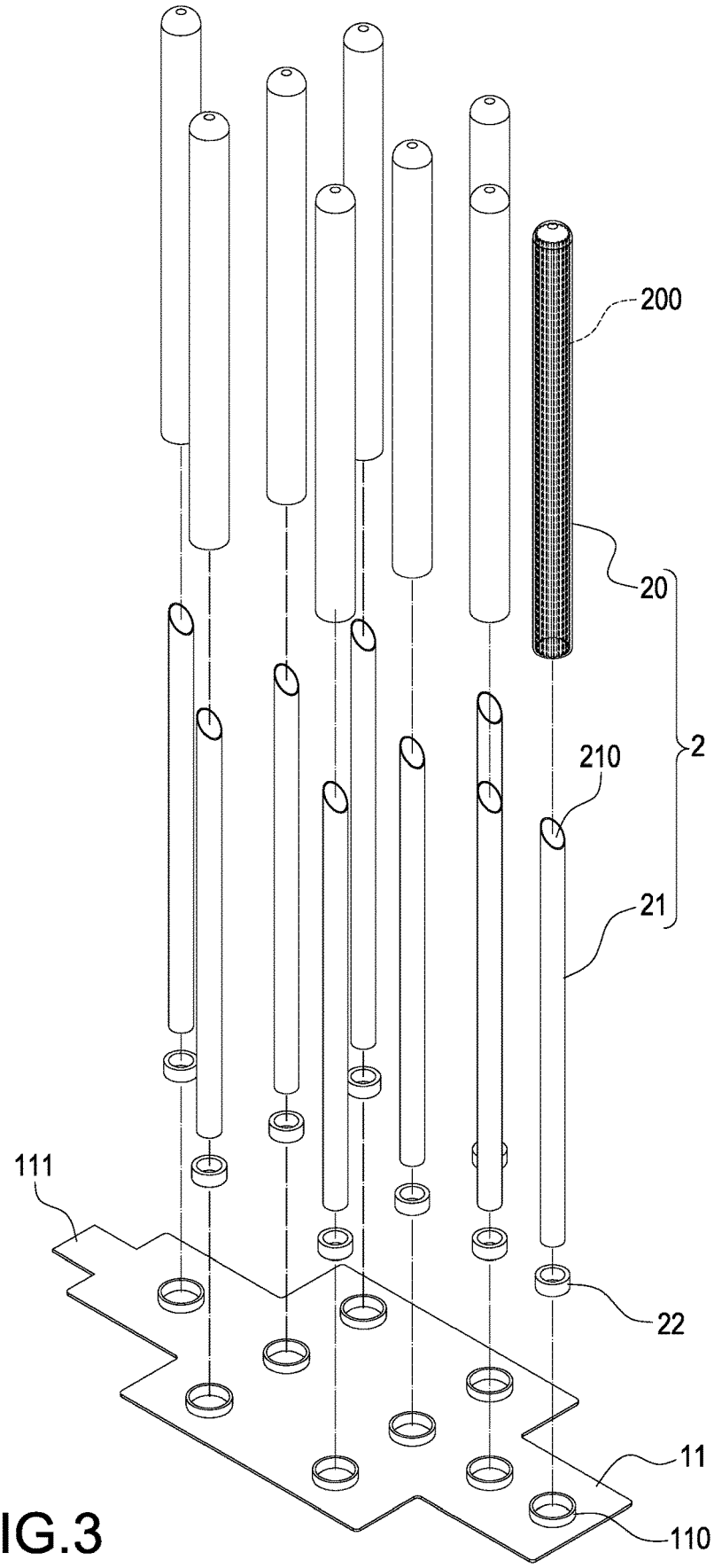
FIG. 3 is a partial exploded view of this disclosure.

In FIG. 3, the heat pipe 2 is erected from the vapor chamber 1. In an embodiment of the present disclosure, the heat pipe 2 is erected from the second board 11. Further, the second board 11 has at least one hole edge 110 for the heat pipe 2 to pass (and to be installed), and each heat pipe 2 includes an outer pipe 20 and an inner pipe 21 passing (and installed in) the outer pipe 20. One end of the outer pipe 20 is closed, and the other end of the outer pipe is open and communicates with the hole edge 110, and two ends of the inner pipe 21 are open, and one end of the inner pipe 21 passes through the hole edge 110 and communicates with the interior of the vapor chamber 1, and the other end of the inner pipe 21 is extended along the axial direction (the length direction) of the outer pipe 20 to form at least one port 210, and the port 210 is provided for communicating the closed end of the outer pipe 20 with the interior of the inner pipe 21 as shown in FIG. 5.

Figure 4:
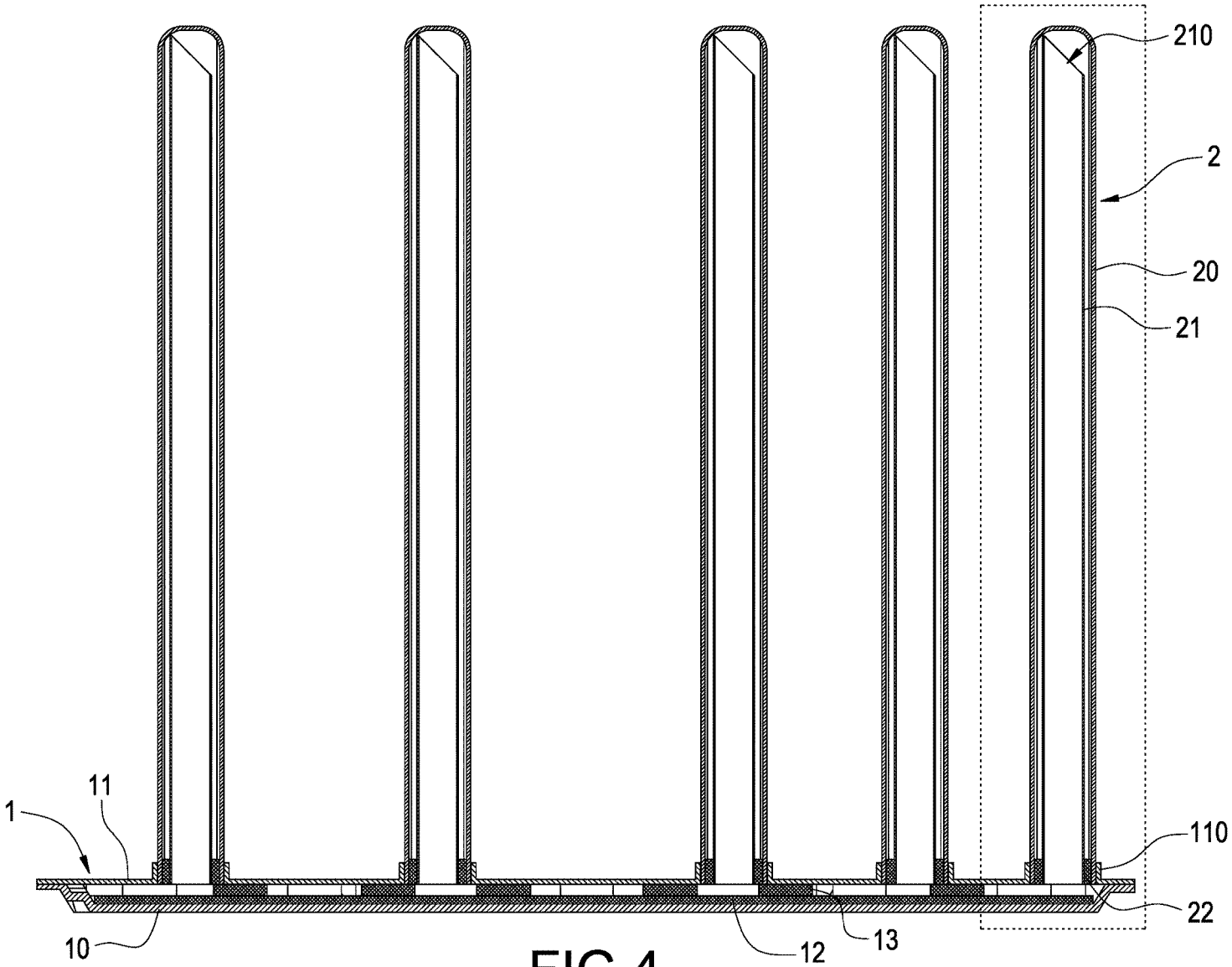
FIG. 4 is a cross-sectional view of this disclosure.
Figure 5:
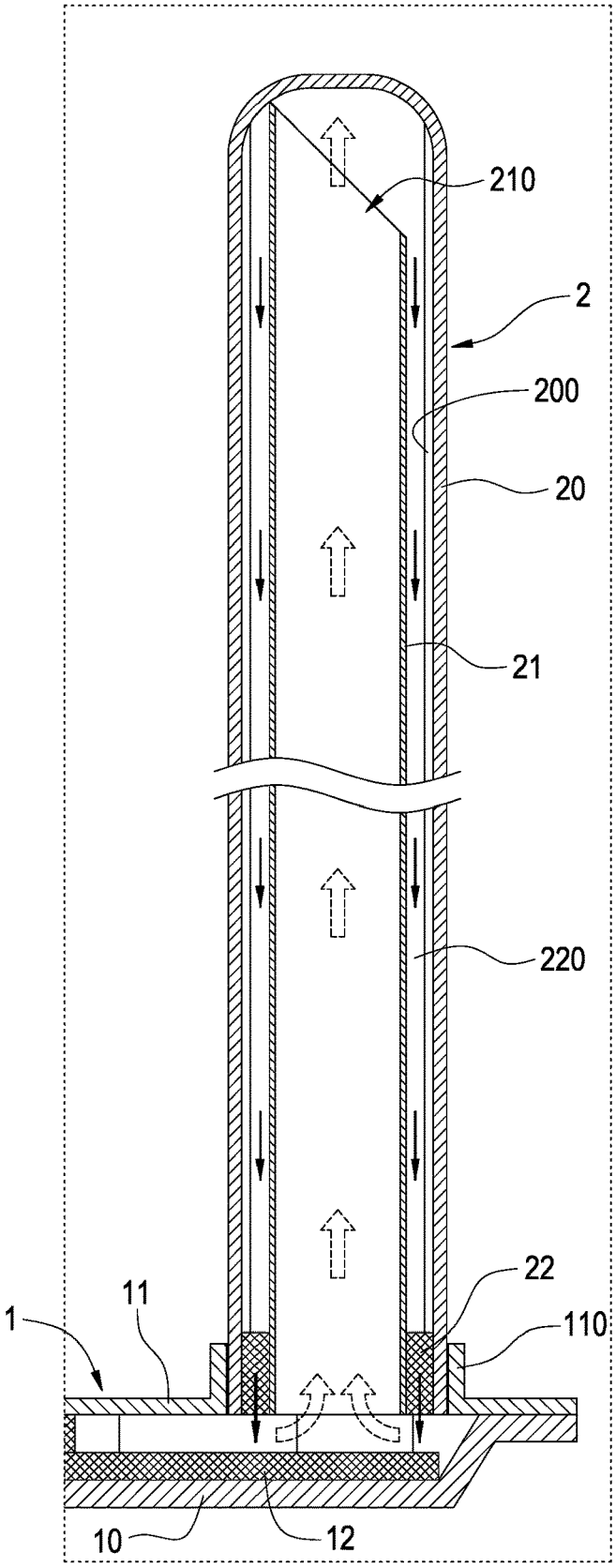
FIG. 5 is a partial blowup view according to FIG. 4.

In the present disclosure as shown in FIGS. 4 and 5, the inner pipe 21 is installed in the outer pipe 20 to form a gap 220 annularly, and the port 210 communicates with the gap 220, so that the vapor chamber 1 and the heat pipe 2 collectively have an inner loop that communicates to a lower end of the inner pipe 21 from the interior of the vapor chamber 1, and communicates to the interior of the outer pipe 21 from the port 210 through the inner pipe 20, and then communicates back to the interior of the vapor chamber through the gap 220.

With the aforementioned structure and assembly, the heat conduction device with the inner loop of the present disclosure is accomplished.

Figure 6:
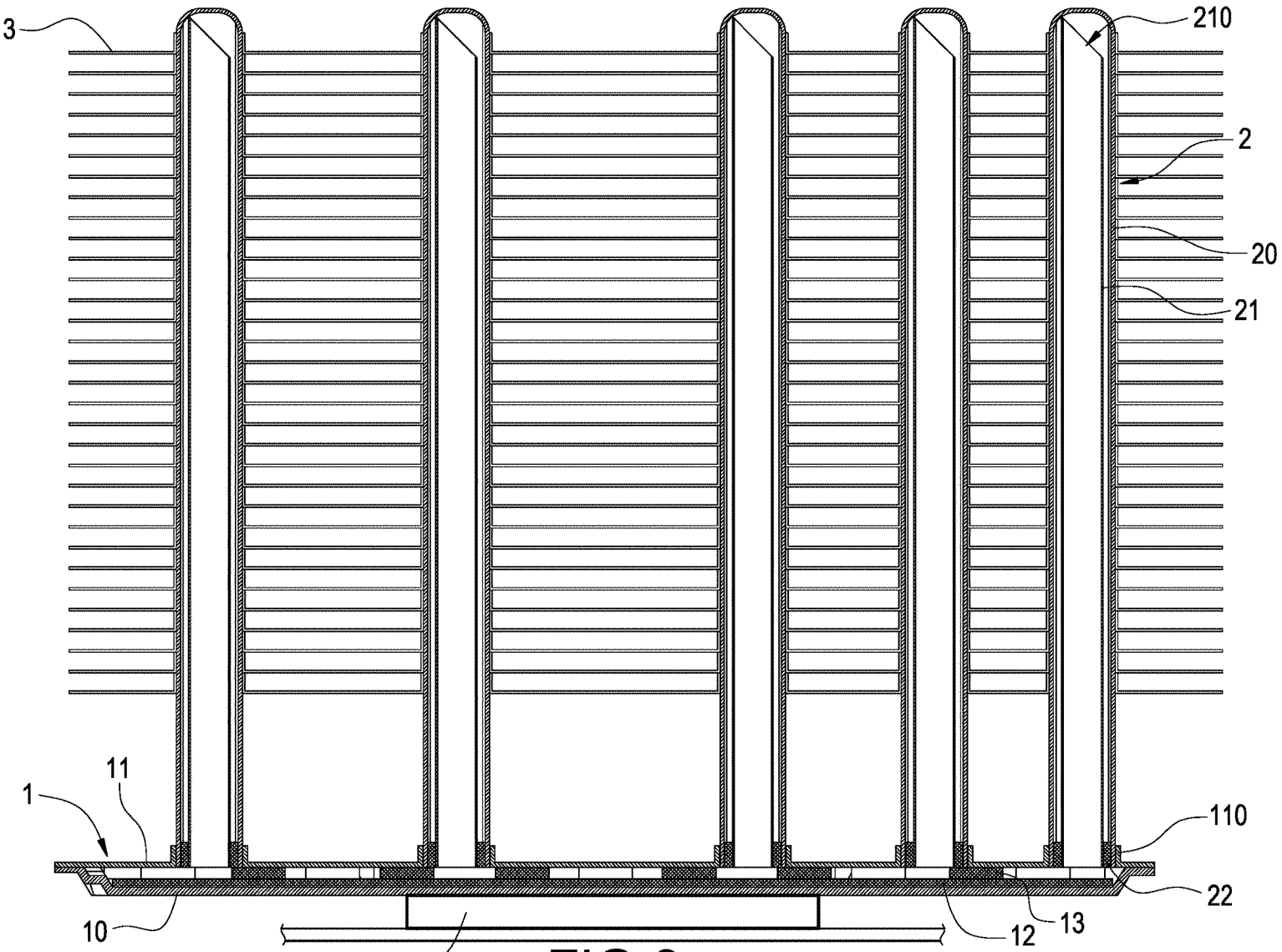
FIG. 6 is a schematic cross-sectional view showing a practical application of this disclosure.

In FIG. 6, in some embodiments, an amount of the heat pipe 2 is multiple for the application of the present disclosure, and each heat pipe 2 has a plurality of fins 3 disposed on or coupled to the heat pipe 2 to assist the condensation, and the vapor chamber 1 is attached to a heat source 4 for the heat source 4 to perform heat dissipation. In FIG. 5, when the working fluid in the vapor chamber 1 is vaporized by the heat generated by the heat source 4, the vaporized working fluid (as indicated by the dotted arrow in the figure) passes through the lower end of the inner pipe 21 of the heat pipe 2 and flows upward accordingly, and then passes through the port 210 at the upper end of the inner pipe 21 to the interior of the outer pipe 20. At the same time, the temperature of the outer pipe 20 is approximately equal to the temperature outside and may be used for the fins 3 to condense, so that the vaporized working fluid is cooled to return back to the liquid-state (as indicated by the solid arrow in the figure), and the liquid-state working fluid attaches to the inner wall of the outer pipe 20 and flows along the annular gap 220 back into the vapor chamber 1. During the reflow process, the liquid-state working fluid is separated from the vaporized working fluid that passes through the inner pipe 21, so that these working fluids do not interfere with each other, so as to maintain the flow rate of these working fluids to facilitate the smooth heat transmission and heat exchange and prevent the liquid-state working fluid from being unable to flow back and causing dry burning or any unwanted situation.

In addition, the present disclosure further has a groove 200 formed on the inner wall of the outer pipe 20 of the heat pipe 2 and extended along the axial direction, and a capillary ring 22 installed between the outer pipe 20 and the lower end of the inner pipe 21. The capillary ring 22 is formed by powder sintering and combined between the groove 200 in the lower end of the outer pipe 20 and the outer wall of the lower end of the inner pipe 21. In addition to providing a fixed combination of the outer pipe 20 and the inner pipe 21, the capillary ring 22 is mainly used for collecting the liquid-state working fluid that passes through the gap 220 and flows back into the capillary ring 22 and then into the vapor chamber 1. The inner wall of the inner pipe 21 may be a smooth pipe wall, and the outer wall may add a capillary structure (not shown in the figure) such as a groove, if necessary.

In summation of the description above, this disclosure surely achieves the expected objective of use, and overcomes the drawbacks of the related art. While this disclosure has been described by means of specific embodiments, numerous modifications and variations could be made thereto by those skilled in the art without departing from the scope and spirit of this disclosure set forth in the claims.

What is claimed is:

1. A heat conduction device with an inner loop, the heat conduction device comprising:

a vapor chamber, comprising a first board and a second board covering each other to configure an internal hollow space, and the second board comprising at least one hole edge disposed thereon; and at least one heat pipe, comprising an outer pipe, and an inner pipe passing through the outer pipe, and one end of the outer pipe being closed, and the other end of the outer pipe being open and communicating with the hole edge, and two ends of the inner pipe being open, and one end of the inner pipe communicating with inside of the vapor chamber through the hole edge and the other end of the inner pipe extended along an axial direction of the outer pipe to configure at least one port, and the one end of the outer pipe being closed communicating with the inner pipe through the port;

wherein, the inner pipe is disposed inside the outer pipe to configure a gap annularly, and the inner pipe communicates with the gap through the port, the vapor chamber and the heat pipe collectively comprise an inner loop that communicates inside of the vapor chamber with a lower distal end of the inner pipe, and communicates the port with inside of the outer pipe through inside of the inner pipe, and communicates to inside of the vapor chamber through the gap, wherein, the vapor chamber comprises a capillary structure disposed therein, the vapor chamber comprises a plurality of support structures disposed therein to support between the first board and the second board, a capillary ring is disposed between the outer pipe and the lower distal end of the inner pipe, the outer pipe of the heat pipe comprises a groove disposed on an inner wall thereof and extended along the axial direction from a closed end of the outer pipe till the capillary ring;

the capillary ring is formed by powder sintering and combined between the groove in a lower distal end of the outer pipe and an outer wall of the lower distal end of the inner pipe, in addition to providing a fixed combination of the outer pipe and the inner pipe, the capillary ring is mainly used for collecting liquid-state working fluid that passes through the gap and flows back into the capillary ring and then into the vapor chamber;

the support structures and the capillary structure are sintered in a one-piece form, and the capillary ring, the support structures and the capillary structure being sintered are all in the powder sintering, and both of the first and second boards have a degassing part extended out from a side of the first board and the second board separately, and after the first and second boards cover with each other, a degassing port is reserved and provided for a degassing operation after the first and second boards are sealed.

2. The heat conduction device according to claim 1, wherein the first board comprises an accommodating portion concavely disposed thereon, and the accommodating portion is covered by the second board to configure the internal hollow space in the vapor chamber.

3. The heat conduction device according to claim 1, wherein an amount of the heat pipe is multiple, and an amount of the hole edge is multiple depending on the amount of the heat pipes.

4. The heat conduction device according to claim 1, wherein the heat pipe comprises a plurality of fins disposed thereon.

* * * * *